US007762642B2

(12) United States Patent
Fellingham et al.

(10) Patent No.: US 7,762,642 B2
(45) Date of Patent: Jul. 27, 2010

(54) MEDIA ADVANCE CALIBRATION

(75) Inventors: Peter J. Fellingham, San Diego, CA (US); David A. Neese, Escondido, CA (US)

(73) Assignee: Eastman Kodak Company, Rochester, NY (US)

( * ) Notice: Subject to any disclaimer, the term of this patent is extended or adjusted under 35 U.S.C. 154(b) by 115 days.

(21) Appl. No.: 12/241,112

(22) Filed: Sep. 30, 2008

(65) Prior Publication Data

US 2010/0078870 A1 Apr. 1, 2010

(51) Int. Cl.
*B41J 29/38* (2006.01)
*B41J 29/393* (2006.01)

(52) U.S. Cl. ..... 347/16; 347/19

(58) Field of Classification Search ..... 347/16, 347/101

See application file for complete search history.

(56) References Cited

U.S. PATENT DOCUMENTS 5,825,378 A 10/1998 Beauchamp
6,076,915 A * 6/2000 Gast et al. ..... 347/19
6,137,592 A 10/2000 Arquilevich et al.
7,021,732 B2 * 4/2006 Folkins ..... 347/8
7,210,758 B2 5/2007 Corner et al.
7,380,898 B2 * 6/2008 Plante et al. ..... 347/19
2002/0063871 A1 5/2002 Kinas

FOREIGN PATENT DOCUMENTS

JP 2005066935 A * 3/2005

OTHER PUBLICATIONS

Machine translation of JP patent document 2005-066935A to Komatsu, Shinya; Acquired on Mar. 1, 2010 via http://www.ipdl.inpit.go.jp/homepg_e.ipdl.*

* cited by examiner

*Primary Examiner*—Matthew Luu
*Assistant Examiner*—Shelby Fidler
(74) *Attorney, Agent, or Firm*—William R. Zimmerli

(57) ABSTRACT

A method of calibrating a media advance in a printer includes providing a mask to specify a printing configuration of a calibration target; forming a media feed calibration target on the print media by: i. printing the calibration target, ii. advancing the print media, iii. printing the calibration target; iv. advancing the print media by the previous media advance amount plus an offset amount, and v. repeating steps iii. and iv. until the media feed calibration target is complete; measuring the optical reflectance of the media feed calibration target as a function of position along the media feed calibration target; identifying a position along the media feed calibration target corresponding to the location at which a maximum in the optical reflectance occurs; and comparing the location at which a maximum in the optical reflectance occurs to a predetermined location of the media feed calibration target to calibrate media advance.

18 Claims, 11 Drawing Sheets

FIG. 11A
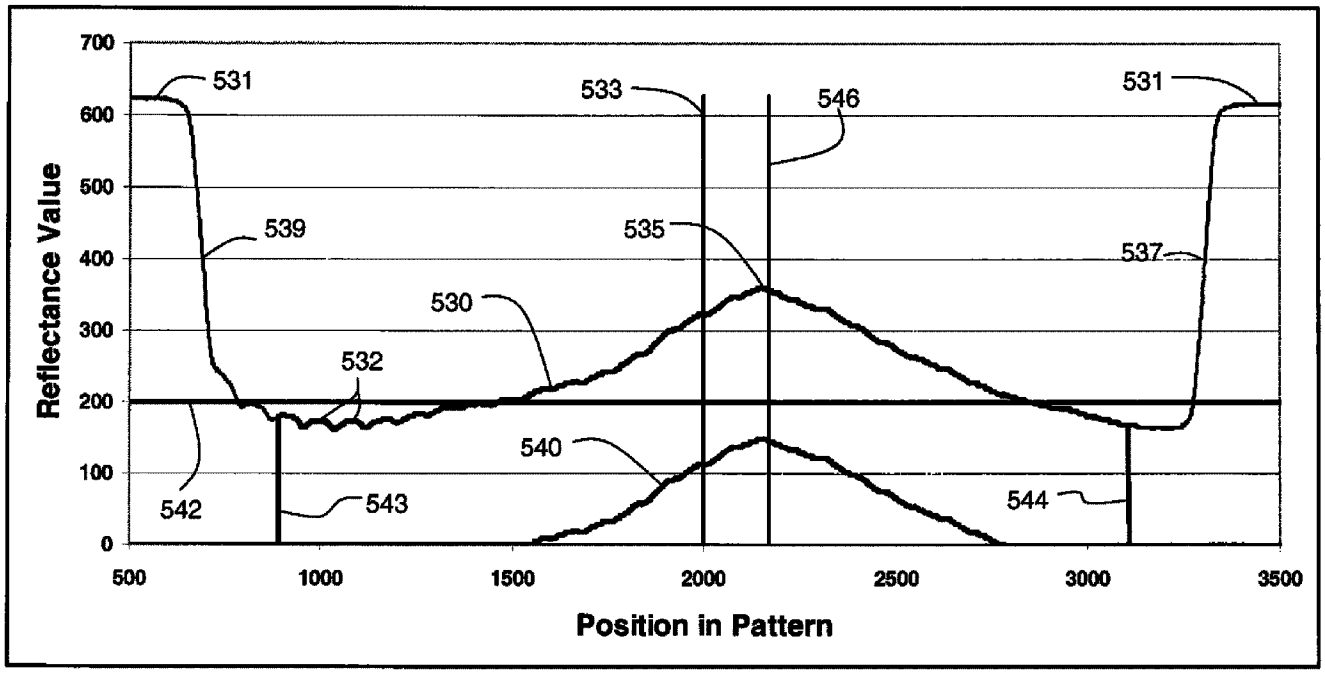
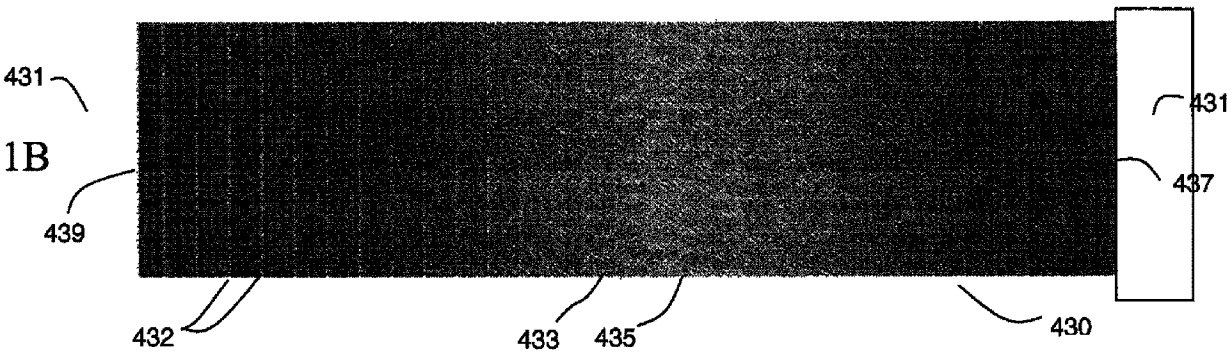
FIG. 11B

MEDIA ADVANCE CALIBRATION

FIELD OF THE INVENTION

This invention relates generally to the field of digitally controlled printing devices, and in particular to calibrating media advance through these devices.

BACKGROUND OF THE INVENTION

Many types of printing systems include one or more printheads that have arrays of marking elements that are controlled to make marks of particular sizes, colors, etc. in particular locations on the print media in order to print the desired image. In some types of printing systems the array of marking elements extends across the width, and the image can be printed one line at a time. However, the cost of a printhead that includes a page-width array of marking elements is too high for some types of printing applications, so a carriage printing architecture is used.

In a carriage printing system (whether for desktop printers, large area plotters, etc.) the printhead or printheads are mounted on a carriage that is moved past the recording medium in a carriage scan direction as the marking elements are actuated to make a swath of dots. At the end of the swath, the carriage is stopped, printing is temporarily halted and the recording medium is advanced. Then another swath is printed, so that the image is formed swath by swath. In a carriage printer, the marking element arrays are typically disposed along an array direction that is substantially parallel to the media advance direction, and substantially perpendicular to the carriage scan direction.

Recording media, whether supplied as cut sheets or from continuous rolls of media, is typically advanced by a set of rollers driven by a motor. The amount of roller angular rotation is controlled by the printer controller. Angular rotation $\theta$ can be implemented by specifying a number of advance steps by a stepper motor, and/or $\theta$ can be monitored by use of a rotary encoder that is mounted coaxially with a feed roller, for example. The distance that media has been advanced is nominally $R\theta$, where R is the radius of the media advance roller that is coaxially mounted with the rotary encoder and where $\theta$ is measured in radians. However, there are a variety of sources of error in this nominal media advance distance. First of all, manufacturing variability or wear in rollers can result in a roller radius that is not exactly equal to R. Secondly, the distance of advance of the side of the paper on which marking will occur is actually $(R+t)\theta$, where t is the thickness of the media being advanced. Media thickness can therefore affect the advance distance. Thirdly, there can be slippage between the media and the roller.

For the case of under feeding the media, media advance errors can result in dark streaks in the image because adjacent swaths of printed data partially overlap. For the case of over feeding the media, media advance errors can result in white streaks in the image because there is a gap between adjacent swaths of printed data. In addition, overfeeding and underfeeding also results in the overall image length being too long or too short. Especially for long images, even relatively small systematic error in media feed distance can result in problems in framing or tiling of images.

A variety of methods for correcting for media advance errors have previously been disclosed. U.S. Pat. No. 5,825,378 discloses printing a series of lines, where successive lines are separated by media advance steps. The line spacing can then be measured by rotating the sheet of media 90 degrees and measuring the distance between lines using an optical sensor that is mounted on the carriage. The actual distance between lines is compared to the nominal distance between lines and the error is used to correct the angular rotation that the roller is to be advanced for a given desired media advance. This method requires direct user intervention to rotate the media.

U.S. Pat. No. 6,137,592 discloses printing a test pattern using successively increasing or decreasing values of media feed. The user then selects the region of the test pattern having a minimum amount of light or dark streaking. The media advance selected can then be stored in memory as the new nominal advance distance. This method requires user intervention to select the best looking portion of the test image, and is susceptible to user error.

U.S. Pat. No. 7,210,758 discloses printing a test pattern including an on-off pattern such as a checkerboard and incrementing media feed values. At an optimal media feed, the dark patterns from a first pass will line up with the light patterns from a second pass, so that the pattern appears darkest (maximum optical density) for the optimal media feed. Examination of the printed pattern can be done automatically by measuring optical density of the pattern and identifying the optimal media feed value as corresponding to the region of the test pattern having the maximum optical density.

While the aforementioned methods are satisfactory for some applications, as customer expectations for improved image quality continue to increase, there is a need for a media feed calibration method that is even more precise and less susceptible to measurement error.

SUMMARY OF THE INVENTION

According to one aspect of the present invention, a method of calibrating a media advance in a printer, the printer including an array of marking elements that are disposed along a direction that is substantially parallel to a direction of media advance, includes: providing a mask to specify a printing configuration of a calibration target; forming a media feed calibration target on the print media by: i. printing the calibration target on a print media using the array of the marking elements, ii. advancing the print media by a media advance amount, iii. printing the calibration target on the print media using the array of the marking elements; iv. advancing the print media by the previous media advance amount plus an offset amount, and v. repeating steps iii. and iv. until the media feed calibration target is complete; measuring the optical reflectance of the media feed calibration target as a function of position along the media feed calibration target; identifying a position along the media feed calibration target corresponding to the location at which a maximum in the optical reflectance occurs; and comparing the location at which a maximum in the optical reflectance occurs to a predetermined location of the media feed calibration target to calibrate media advance in the printer.

According to another aspect of the present invention, the method described above can also include forming a second media feed calibration target on the print media by: i. printing the calibration target on a print media using the array of the marking elements, ii. advancing the print media by a media advance amount, iii. printing the calibration target on the print media using the array of the marking elements; iv. advancing the print media by the previous media advance amount, and v. repeating steps iii. and iv. until the media feed calibration target is complete; measuring the optical reflectance of the second media feed calibration target as a function of position along the second media feed calibration target; identifying and storing a periodic variation in the optical reflectance as a function of angular rotation; and adjusting rotation of a media advance roller based on the stored periodic variation and the position of a marker that indicates the particular angular position of the roller.

According to another aspect of the present invention, a method of calibrating a media advance in a printer, the printer including a media advance roller, a marker to indicate a particular angular position of the roller, and an array of marking elements that are disposed along a direction that is substantially parallel to a direction of media advance, includes: providing a mask to specify a printing configuration of a calibration target; forming a media feed calibration target on the print media by: i. printing the calibration target on a print media using the array of the marking elements, ii. advancing the print media by a media advance amount, iii. printing the calibration target on the print media using the array of the marking elements; iv. advancing the print media by the previous media advance amount, and v. repeating steps iii. and iv. until the media feed calibration target is complete; measuring the optical reflectance of the media feed calibration target as a function of position along the media feed calibration target; identifying and storing a periodic variation in the optical reflectance as a function of angular rotation; and adjusting rotation of the media advance roller based on the stored periodic variation and the position of the marker that indicates the particular angular position of the roller.

BRIEF DESCRIPTION OF THE DRAWINGS

In the detailed description of the preferred embodiments of the invention presented below, reference is made to the accompanying drawings, in which:

FIG. 11A shows a plot of the photosensor signal as a function of position corresponding to scanning the media feed calibration target of FIG. 6.

FIG. 11B shows the media feed calibration target of FIG. 6 rotated clockwise by 90 degrees to clarify the relationship of features of the target and the plot in FIG. 11A.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
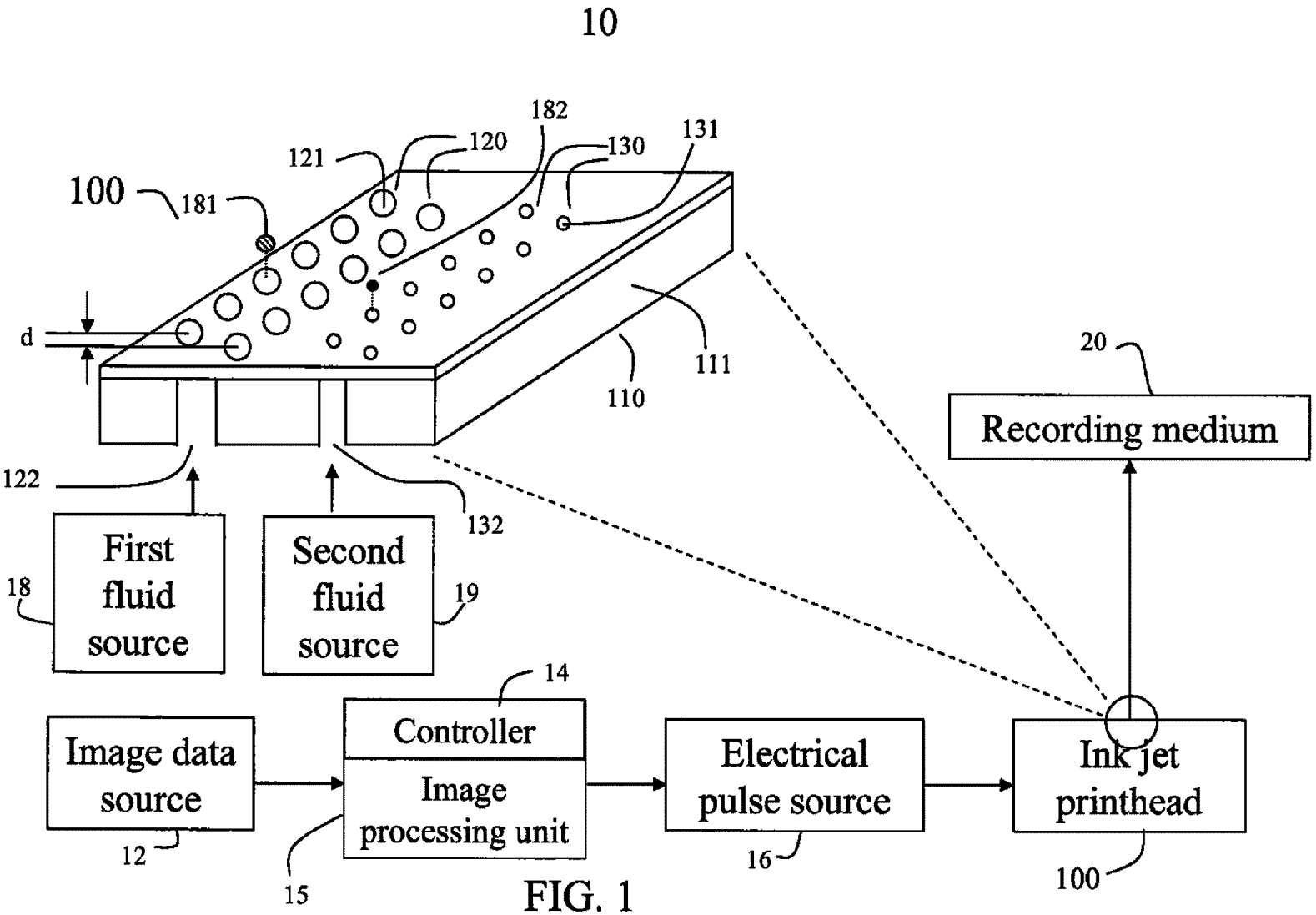
FIG. 1 is a schematic representation of an inkjet printer system.

Referring to FIG. 1, a schematic representation of an inkjet printer system 10 is shown, as described in U.S. Pat. No. 7,350,902, and incorporated by reference herein in its entirety. Printer system 10 includes a source 12 of image data, which provides data signals that are interpreted by a controller 14 as being commands to eject drops. Controller 14 includes an image processing unit 15 for rendering images for printing, and outputs signals to a source 16 of electrical energy pulses that are inputted to an inkjet printhead 100, which includes at least one printhead die 110.

In the example shown in FIG. 1, there are two nozzle arrays 120, 130 for inkjet printhead 100. Nozzles 121 in the first nozzle array 120 have a larger opening area than nozzles 131 in the second nozzle array 130. In this example, each of the two nozzle arrays 120, 130 has two staggered rows of nozzles, each row having a nozzle density of 600 per inch. The effective nozzle density then in each array 120, 130 is 1200 per inch. If pixels on the recording medium were sequentially numbered along the paper advance direction, the nozzles from one row of an array would print the odd numbered pixels, while the nozzles from the other row of the array would print the even numbered pixels. Even though neighboring pixels are printed by nozzles in different rows of the array in a staggered array geometry of marking elements, the marking elements that produce neighboring marking pixels are considered to be neighboring marking elements. Nozzle number one in the nozzle array is in the same row as nozzle number three in this example, while nozzle number two is in the other row. The physical distance between nozzle number one and nozzle number three is $1/600$ inch. The center to center distance between nozzle number two and nozzle number one may be greater than $1/600$ inch due to the spacing between rows of the array. However the distance along the array direction between nozzle number one and nozzle number two is $d=1/1200$ inch in this example. The corresponding pixel spacing in the array direction is also $1/1200$ inch in this example.

In fluid communication with each nozzle array is a corresponding ink delivery pathway. Ink delivery pathway 122 is in fluid communication with nozzle array 120, and ink delivery pathway 132 is in fluid communication with nozzle array 130. Portions of fluid delivery pathways 122 and 132 are shown in FIG. 1, as openings through printhead die substrate 111. One or more printhead die 110 can be included in inkjet printhead 100, but only one printhead die 110 is exemplarily shown in FIG. 1 for simplistic illustrative purposes. The printhead die is arranged on a support member as discussed below relative to FIG. 2. In FIG. 1, a first ink source 18 supplies ink to first nozzle array 120 via ink delivery pathway 122, and a second ink source 19 supplies ink to second nozzle array 130 via ink delivery pathway 132. Although distinct ink sources 18 and 19 are shown, in some applications it may be beneficial to have a single ink source supplying ink to both nozzle arrays 120 and 130 via ink delivery pathways 122 and 132 respectively. Also, in some embodiments, fewer than two nozzle arrays are included on printhead die 110, in other embodiments more than two nozzle arrays are used. In some embodiments, all nozzles on a printhead die 110 may be the same size, rather than having multiple sized nozzles on a printhead die.

Drop forming mechanisms (not shown in FIG. 1) are associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bilayer element) and thereby cause ejection. In any case, electrical pulses from pulse source 16 are sent to the various drop ejectors according to the desired deposition pattern. In the example of FIG. 1, droplets 181 ejected from nozzle array 120 are larger than droplets 182 ejected from nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording media 20.

Figure 2:
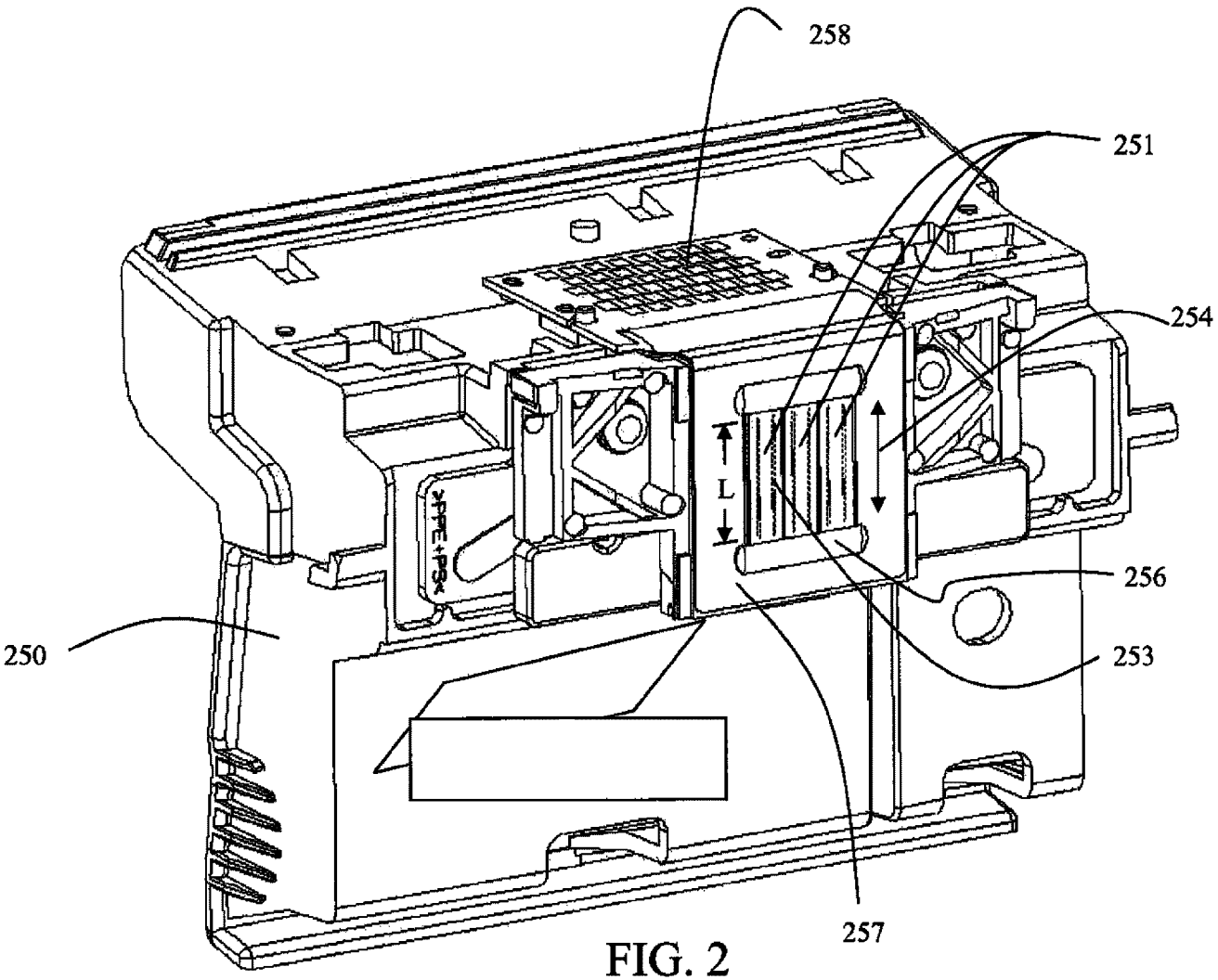
FIG. 2 is a perspective view of a portion of a printhead chassis.

FIG. 2 shows a perspective view of a portion of a printhead chassis 250, which is an example of an inkjet printhead 100. Printhead chassis 250 includes three printhead die 251 (similar to printhead die 110), each printhead die containing two nozzle arrays 253, so that printhead chassis 250 contains six nozzle arrays 253 altogether. The six nozzle arrays 253 in this example may be each connected to separate ink sources (not shown in FIG. 2), such as cyan, magenta, yellow, text black, photo black, and a colorless protective printing fluid. Each of the six nozzle arrays 253 is disposed along direction 254, and the length L of each nozzle array along direction 254 is typically on the order of 1 inch or less. Typical lengths of recording media are 6 inches for photographic prints (4 inches by 6 inches), or 11 inches for 8.5 by 11 inch paper, while roll-fed printers can use media lengths as long as 100 feet or more. Thus, in order to print the full image, a number of swaths are successively printed while moving printhead chassis 250 across the recording media. Following the printing of a swath, the recording media is advanced along a media advance direction 304 that is substantially parallel to nozzle array direction 254.

A single pass print mode is one in which each marking element in the array is assigned to print all of the pixel locations within a given row of pixels in a single swath. Single pass print modes are relatively fast and are typically used in draft modes. However, if a jet is misdirected or malfunctioning in other ways, single pass print modes can result in objectionable white or dark streaks in the printed image. Therefore, higher quality print modes use multiple overlapping passes to print the image. In multi-pass printing, print masks are used to assign responsibility to different marking elements for printing the various printing locations within a row of pixels. In addition, the media advance distance between printing passes is less than the length of the nozzle array in multi-pass printing. Instead, if the length of the nozzle array is L and the number of passes in the multi-pass print is m, then the desired media advance distance will be approximately L/m.

A flex circuit 257 to which the printhead die 251 are electrically interconnected, for example by wire bonding or TAB bonding, is also shown in FIG. 2. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals may be transmitted to the printhead die 251.

Figure 3:
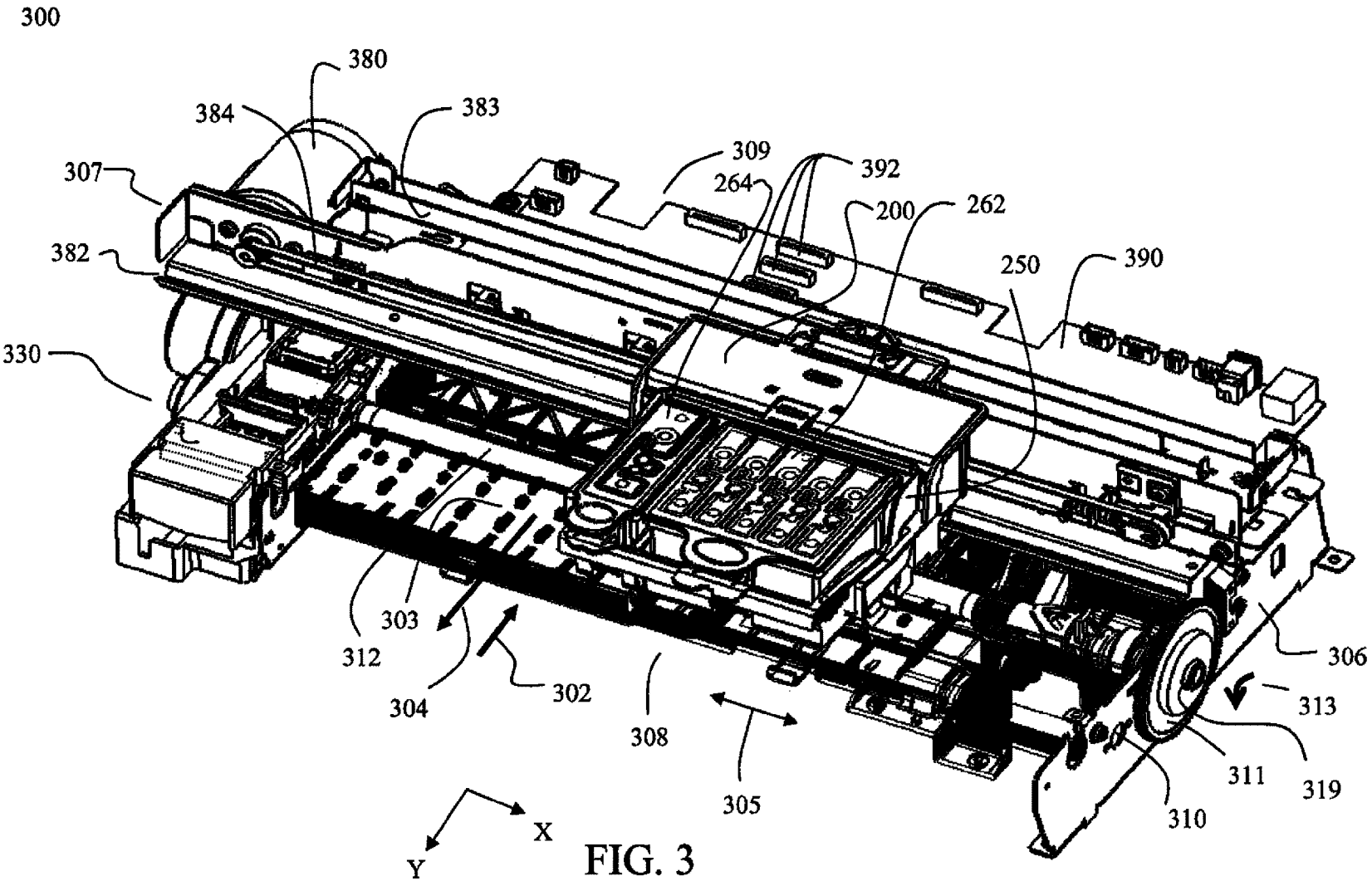
FIG. 3 is a perspective view of a portion of a carriage printer.

FIG. 3 shows a portion of a desktop carriage printer. Some of the parts of the printer have been hidden in the view shown in FIG. 3 so that other parts may be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 on printhead chassis 250 that is mounted on carriage 250. Carriage motor 380 moves belt 384 to move carriage 200 along carriage guide rail 382. An encoder sensor (not shown) is mounted on carriage 200 and indicates carriage location relative to an encoder fence 383.

Figure 4:
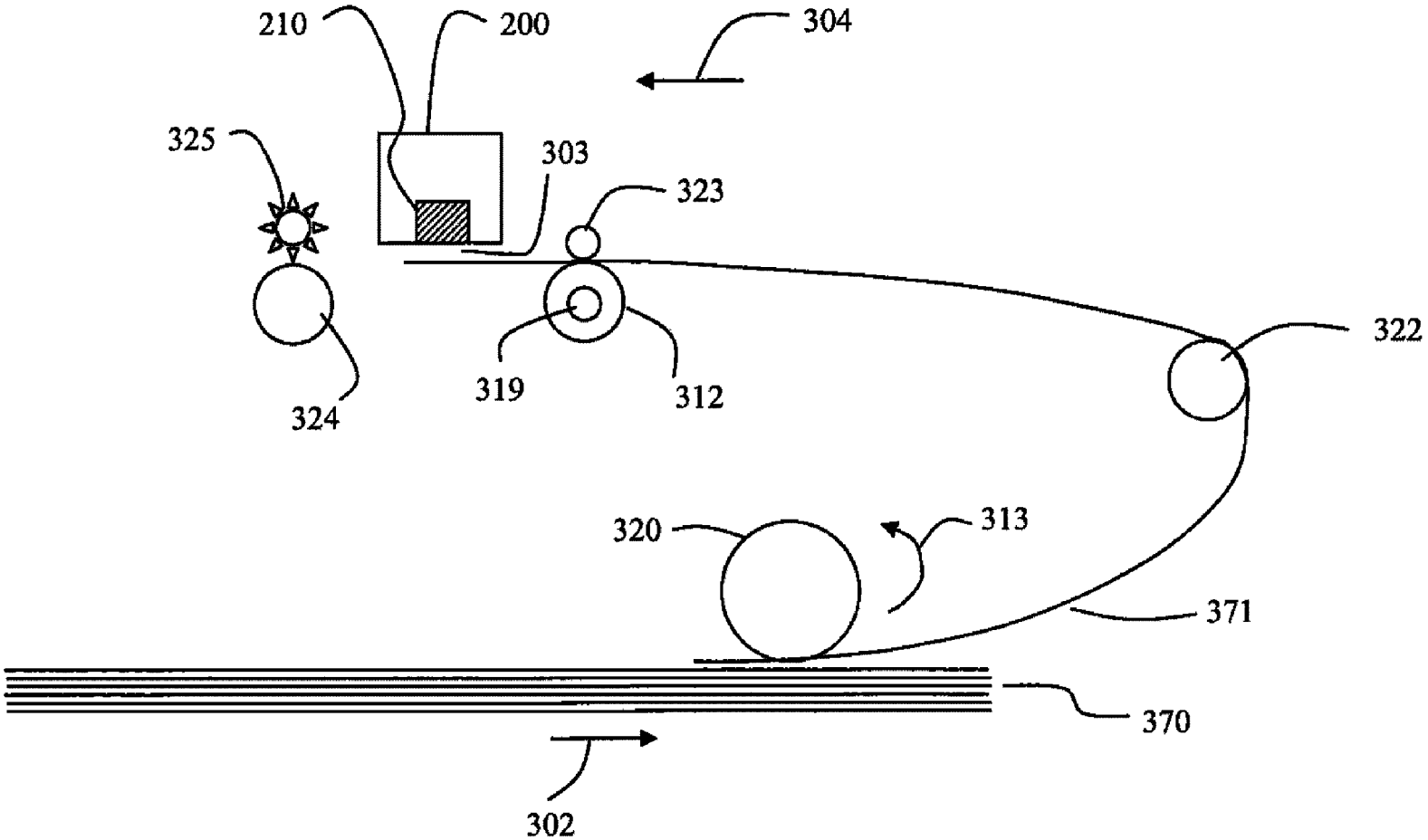
FIG. 4 is a schematic side view of a paper path in a carriage printer.

Also mounted on carriage 200 is an optical sensor (also called a carriage sensor) 210, as shown in FIG. 4. Carriage sensor 210 includes a light emitter such as an LED that shines light onto the recording medium. Light reflected from the recording medium is received by a photosensor that is also included in carriage sensor 210. A common use of a carriage sensor 210 in prior art is to evaluate printhead alignment by providing an electronic signal that that may be analyzed to determine the positions of printed marks.

Printhead chassis 250 is mounted in carriage 200, and ink supplies 262 and 264 are mounted in the printhead chassis 250. The mounting orientation of printhead chassis 250 is rotated relative to the view in FIG. 2, so that the printhead die 251 (shown in FIG. 2) are located at the bottom side of printhead chassis 250, the droplets of ink being ejected downward onto the recording media in print region 303 in the view of FIG. 3. Ink supply 262, in this example, contains five ink sources cyan, magenta, yellow, photo black, and colorless protective fluid, while ink supply 264 contains the ink source for text black. Paper, or other recording media (sometimes generically referred to as paper, media or print media herein) is loaded, in this example, along paper load entry direction 302 at the front portion 308 of printer chassis 300.

A variety of rollers are used to advance the recording media through the printer, as shown schematically in the side view of FIG. 4. In this example, a pickup roller 320 moves the top sheet 371 of a stack 370 of paper or other recording media in the direction of arrow 302. A turn roller 322, toward the rear portion 309 of the printer chassis 300 shown in FIG. 3, acts to move the paper around a C-shaped path (in cooperation with a curved rear wall surface) so that the paper continues to advance along direction arrow 304 from the rear direction 309 of the printer shown in FIG. 3. The paper is then moved by feed roller 312 and idler roller(s) 323 to advance along the Y axis 9 in FIG. 3) and across print region 303, and from there to a discharge roller 324 and star wheel(s) 325 so that a paper, printed with an image, exits along direction 304. In the vicinity of the print region 303, the paper is fed along direction 304, so that with regard to printing, direction 304 is referred to as the media feed direction. Feed roller 312 includes a feed roller shaft 319 along its axis, and feed roller gear 311 is mounted on the feed roller shaft 319. Feed roller 312 can include of a separate roller mounted on feed roller shaft 319, or a thin high friction coating on feed roller shaft 319. A rotary encoder (not shown) can also be coaxially mounted with feed roller 312 on shaft 319, so that it can monitor the angular rotation θ of feed roller 312.

The motor (e.g. a DC servo motor or a stepper motor) that powers the paper advance rollers is not shown in FIG. 1, but the hole 310 at the right side 306 of the printer chassis 300 (shown in FIG. 3) is where the motor gear (not shown) protrudes through in order to engage feed roller gear 311, as well as the gear for the discharge roller (not shown). For normal paper pick-up and feeding, it is desired that all rollers rotate in forward direction 313. Toward the left side 307 in the example chassis 300 shown in FIG. 3 is the maintenance station 330.

Toward the rear portion 309 of the printer in chassis 300 is located electronics board 390, which includes cable connectors 392 for communicating via cables (not shown) to the printhead carriage 200 and from there to the printhead chassis 250. Also mounted on the electronics board 390 are motor controllers for the carriage motor 380 and for the paper advance motor, a processor and/or other control electronics (shown schematically as 14 and 15 in FIG. 1) for controlling the printing process, including image processing, and an optional connector for a cable to a host computer.

Embodiments of the present invention make use of the fact that, particularly for a dark color ink such as black, the optical density of a region having multiple layers of ink dots in a particular location on a white recording medium is not much greater than the optical density of a single layer of dots.

However, if the various layers of dots are displaced from each other so that the group of dots covers a greater area of the white recording medium, then the optical density of the region does increase significantly. (Correspondingly the optical reflectance of a region having dots covering a greater area of the white recording medium decreases significantly.) A special type of print mask is used to print a media feed calibration target, such that corresponding marking elements in different sections of the printhead are directed by the mask to print dots that will land on top of each other if the actual media feed distance is equal to the nominal media feed distance, but which will be displaced from each other if the actual media feed distance is either greater than or less than the nominal media feed distance. Between printing successive swaths of the media feed calibration target, the media advance distance is successively incremented or decremented. After printing the target, the optical density (or optical reflectance) of the target is measured as a function of position within the target, for example by scanning carriage sensor 210 across the target and analyzing the signal from the photosensor due to light reflected from the target.

The special mask used for the media feed calibration target differs from a typical mask used in multipass printing of images, in that while a mask used in multipass printing of images has complementary patterns of 1's and 0's in the various zones of the mask corresponding to successive passes, the special mask for the media feed calibration target has a substantially identical pattern of 1's and 0's in each zone of the mask. Therefore, if the actual media feed distance were the nominal media feed distance, the special mask would cause multiple layers of dots to land on top of each other.

Figure 5:
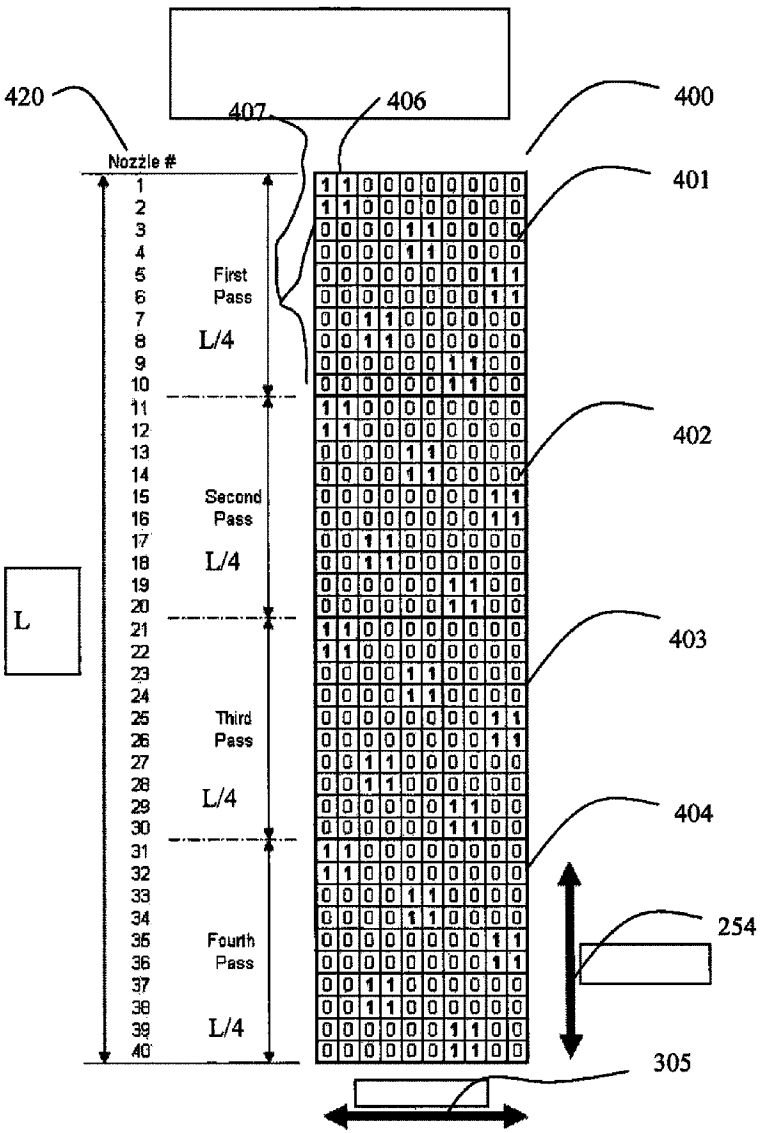
FIG. 5 is an embodiment of a mask for a media feed calibration target.

FIG. 5 shows an example of a mask 400 for a media feed calibration target for 4 pass printing of the target. Printing the entire media feed calibration target requires more than 4 swaths of printing. What is meant by 4 pass printing in this case is that for the nominal media feed distance, corresponding marking elements from each quarter of the printhead deposit four layers of dots (corresponding to the 1's in the mask) in particular regions of the paper.

Exemplary mask 400 is used to control the firing of dots from marking element array 420, where in this example, the marking element array 420 has 40 inkjet nozzles of a single color, such as black or cyan, disposed along nozzle array direction 254, which is substantially parallel to the media feed direction 304. Mask 400 includes 40 rows of entries along the media feed direction 304, corresponding to the 40 inkjet nozzles. The 40 rows are separated into 4 zones of 10 rows each for four pass printing of a media feed calibration target. The patterns of 1's and 0's are substantially identical in each of the four zones. In the example of mask 400, the 1's are arranged as two dimensional clusters, in particular as 2×2 clusters 406. The clusters are separated from one another along the media feed direction 304 by isolation regions 407, which are 2×8 groups of 0's in this example.

Each row of mask 400 has 10 entries along the carriage scan direction 305. When a corresponding nozzle is near a pixel position on the recording medium, the mask directs the printhead either to make a dot at that pixel location corresponding to mask values of 1, or not to make a dot at that pixel location corresponding to mask values of 0. Even though the rows in mask 400 only have 10 entries, the mask is typically tiled across a larger area so that the printed target is significantly larger than 40 pixels by 10 pixels.

For four pass printing (i.e. m=4) of the media feed calibration target, nozzles 1-10 are first used to print dots in the locations corresponding to the first zone 401 of the mask during the first pass as the carriage moves along carriage scan direction 305. In particular, if the carriage 200 is moving left to right, mask 400 would direct nozzles 1 and 2 to fire at the first and second pixel locations along the carriage scan direction 305, nozzles 7 and 8 to fire at the third and fourth pixel locations along the carriage scan direction 305, nozzles 3 and 4 to fire at the fifth and sixth pixel locations along the carriage scan direction 305, etc. Then the media is advanced by a distance that is approximately equal to L/m, i.e. by about 10 pixel spacings, plus an offset amount to be described below. During the second pass of printing, nozzles 1-10 print the pattern corresponding to the first zone 401 of the mask on a previously unmarked region of paper, while nozzles 11-20 print the pattern corresponding to the second zone 402 of the mask 400 in the same region that nozzles 1-10 just printed. As a result, nozzles 11 and 12 print a cluster of 4 dots substantially on top of the cluster of dots just printed by nozzles 1 and 2, etc. Then the media is advanced by a distance that is approximately equal to L/m, i.e. by about 10 pixel spacings, incremented again by the offset amount. During the third pass of printing, nozzles 1-10 print the pattern corresponding to the first zone 401 of the mask on a previously unmarked region of paper, while nozzles 11-20 print the pattern corresponding to the second zone 402 of the mask 400 in the same region that nozzles 1-10 just printed, and nozzles 21-30 print the pattern corresponding to the third zone 403 of the mask 400 in the same region that nozzles 11-20 just printed. Then the media is advanced by a distance that is approximately equal to L/m, i.e. by about 10 pixel spacings, incremented yet again by the offset amount. During the fourth pass of printing, nozzles 1-10 print the pattern corresponding to the first zone 401 of the mask on a previously unmarked region of paper, while nozzles 11-20 print the pattern corresponding to the second zone 402 of the mask 400 in the same region that nozzles 1-10 just printed, nozzles 21-30 print the pattern corresponding to the third zone 403 of the mask 400 in the same region that nozzles 11-20 just printed, and nozzles 31-40 print the pattern corresponding to the fourth zone 404 of the mask 400 in the same region that nozzles 21-30 just printed.

As the media feed calibration target is printed, the amount of media feed is incrementally swept to well outside the range of media feed errors normally anticipated for the printing system and/or media type. In one embodiment, the media feed distance is swept from L/m−4 pixels to L/m+4 pixels at 0.25 pixel increments per feed event to provide a media feed calibration target with a very distinctive reflectance signal that can be scanned to determine the correct media feed calibration setting automatically. In other words, the media advance amounts are increased or decreased in successive passes such that the minimum media advance distance is less than L/m and the maximum media advance distance is greater than L/m. In this embodiment the media feed distance of L/m is substantially at the center of the media feed calibration target. The media feed increments to greater than L/m and to less than L/m are disposed symmetrically about the center of the target. This produces a target such that if the actual media feed is equal to the nominal media feed, there will be near perfect overlap of the dots printed by successive passes at the center of the media feed calibration target. The distance between the actual point of near perfect overlap (as measured by a maximum in optical reflectance of the target) and the physical center of the target thus provides a measure of the error in the actual media feed. The nominal media feed distance L/m does not need to be located at the center, and the target does not need to be symmetric in sweep increments about the center, but that is perhaps the simplest version of the target design. Also, the calibration sweep range that would work is not limited to ±4 pixels or feed increments of 0.25 pixel, and systems using other embodiments having wider or narrower sweep ranges could be made to work with appropriate print masking and target dimensions.

The mask dot pattern for exemplary mask 400 shows clusters of 4 dots, i.e. 2×2 clusters of mask value 1 that are isolated from other clusters by regions of mask value 0. It has been found that such clusters of dots reduce the signal loss that occurs from dot placement errors due to misdirected jets, carriage velocity errors, printhead to media spacing variation and nozzle array tilt. However, the method will work with single pixel dots or with more than 4 dots arranged as 2×2 clusters. As described below, clusters which are further elongated along the media feed direction (e.g. a 2×3 cluster) will extend the portion of the media feed calibration target in which overlap occurs between printing of dot clusters in successive passes, in spite of fairly large overfeeding or underfeeding of the media.

Figure 6:
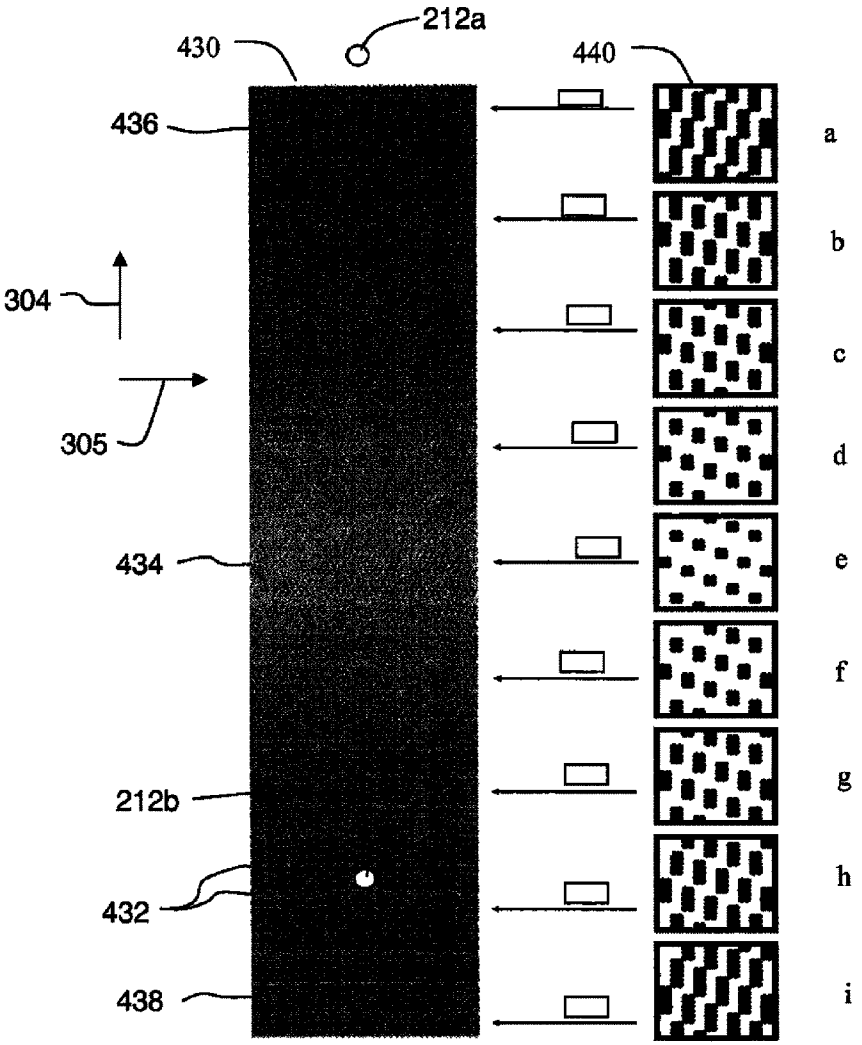
FIG. 6 shows an embodiment of a media feed calibration target.

FIG. 6 shows an embodiment of a media feed calibration target 430 (enlarged slightly in the figure) that has been printed using a mask similar to mask 400 (but with 640 rows rather than 40 rows, and optionally a different dot cluster pattern than shown in mask 400) using 4 pass printing by a inkjet nozzle array of 640 nozzles having a nozzle spacing of $1/1200$ inch. The nominal media feed advance distance for a 640 nozzle printhead for 4 pass printing is 640/4=160 nozzle spacings, i.e. $160/1200$ inch~0.133". However during the printing of the pattern the media feed distance is incremented from an intended 156 pixel spacings (the nominal media feed advance minus 4 pixel spacings) at the top of media feed calibration target 430, to an intended 156.25 pixel spacings, to 156.5, 156.75, 157, . . . 159.75, 160, 160.25, . . . 163.5, 163.75, and finally to an intended 164 pixel spacings at the bottom of media feed calibration target 430. In other words, toward the top of media feed calibration target 430, the media is being underfed, which results in some overlap between adjacent swaths, and toward the bottom of media feed calibration target 430 the media is being overfed, which results in some gaps between adjacent swaths. The gaps are particularly noticeable as the show up as white streaks 432 on a relatively dark background. The white streaks 432 indicate the boundaries between two adjacent swaths in this region of the target.

In the above description, the different media feed distances were designated as an "intended" number of pixel spacings. In other words, knowing the approximate radius $R_o$ of feed roller 312, the feed roller 312 is rotated by a DC servo motor, for example, through an angle θ (as monitored by rotary encoder mounted on feed roller shaft 319) such that $R_o\theta$ equals the intended media feed amount such as 156 pixel spacings, etc. However, due to manufacturing variation or wear of the feed roller 312, the actual radius R of feed roller 312 may not be precisely equal to $R_o$ . In addition there can be other sources of feed error such as media slippage. An intent of the present invention is to relate the actual distance that media is fed for a variety of different intended media feed amounts, and then indicate with high precision the correct amount that media should be fed so that underfeeding and overfeeding can be avoided when printing images.

In boxes 440 FIG. 6 also schematically shows using magnified views a, b, c, . . . i, the approximate appearance of the multi-pass printed dot clusters within the swaths as a function of media feed error. These magnified views are only intended to show schematically the effect of more white paper showing when the dot clusters overlap each other toward the center of media feed calibration target 430, so that the target appears light gray near its center and dark gray toward the ends. Actual configurations of dot clusters as a function of media feed error will be described below.

Also shown schematically in FIG. 6 is the field of view 212 of the photosensor in carriage sensor 210. After printing media feed calibration target 430, carriage 200 is moved along carriage scan direction 305 until field of view 212 of the carriage sensor 210 is aligned with target 430, for example in location 212*a*. Then the DC servo motor turns feed roller 312 at a constant rate so that the paper is moved at a substantially constant speed along media feed direction 305. As the media feed calibration target 430 is moved relative to the field of view 212, the photosensor signal is monitored as a function of nominal position within the target 430, where the nominal position is provided by the rotary encoder that is mounted on feed roller shaft 319. The photosensor signal is larger when more white paper is within field of view 212, and the photosensor signal is smaller when the paper within field of view 212 is covered to a greater extend by printed dots. Thus the photosensor signal will be larger near central position 434 than near end regions 436 or 438. Optionally the photosensor signal is amplified and converted to digital data by an analog to digital converter and stored in printer controller 14 as a function of the nominal position provided by the rotary encoder. The photosensor signal will be at its highest level for unmarked paper, such as when the field of view is at position 212*a*. In the example shown in FIG. 6, field of view 212 is about 3 mm in diameter (0.12") and can fit entirely within a swath, as shown by field of view position 212*b* relative to the distance between white streaks 432.

FIGS. 7-10 show magnified views of configurations of multi-pass printed dot clusters that will be formed in various regions of media feed calibration target 430, assuming four pass printing of 2×2 dot clusters where the media feed increment is one quarter pixel. FIG. 7A shows the vertical position of the individual 2×2 dot clusters printed during each of the four passes in a region of target 430 near position 434 where the media feed error is close to zero. The dot clusters in FIG. 7A are displaced from each other horizontally so that they can be seen individually. The dot cluster composite patterns in FIG. 7B represent the appearance of the overlying dot clusters after each pass. The dotted lines represent spacings of a quarter pixel spacing. Dot cluster 441 is printed, for example by nozzles 1 and 2 in two adjacent positions along the carriage scan direction 305. Each dot in the dot cluster has a diameter of about 1.5 pixel spacings, so that diagonally adjacent dots overlap. Dot cluster 446 (the composite pattern after 1 pass) is the same as dot cluster 441. Dot cluster 442 is printed by nozzles 161 and 162 after a media feed of 159.75 pixel spacings (i.e. a media feed error of minus one quarter pixel spacing) so it is vertically displaced from dot cluster 441 by a quarter pixel. Dot cluster composite 447 shows dot cluster 442 overlying dot cluster 441. Dot cluster composite 447 is idealized from the standpoint that there is no jet misdirectionality between dot clusters 441 and 442, and there is no spreading of the ink as the dot clusters overlap. Because the media feed is incremented by one quarter pixel for each swath of media feed calibration target 430, the media feed amount before dot cluster 443 is 160 pixel spacings, i.e. the nominally correct media feed for 4 pass printing of a 640 jet nozzle array. Thus, dot cluster 443 (printed by nozzles 321 and 322) is at the same vertical position as dot cluster 442, and dot cluster composite 448 looks just like dot cluster composite 447 because dot cluster 443 lands precisely on dot cluster 442. Prior to the printing of dot cluster 444 by nozzles 481 and 482, the media is advanced 160.25 pixel spacings (i.e. a media feed error of plus one quarter pixel spacing). Dot cluster composite 449 looks just like dot cluster composites 447 and 448 because dot cluster 444 lands precisely on dot cluster 441. Dot cluster composite is the actual configuration of dot cluster composites in box e of FIG. 6, assuming no jet misdirectionality and actual media feeds approximately equal to the nominal media feed of 160 pixel spacings.

Figures 7A, 7B:
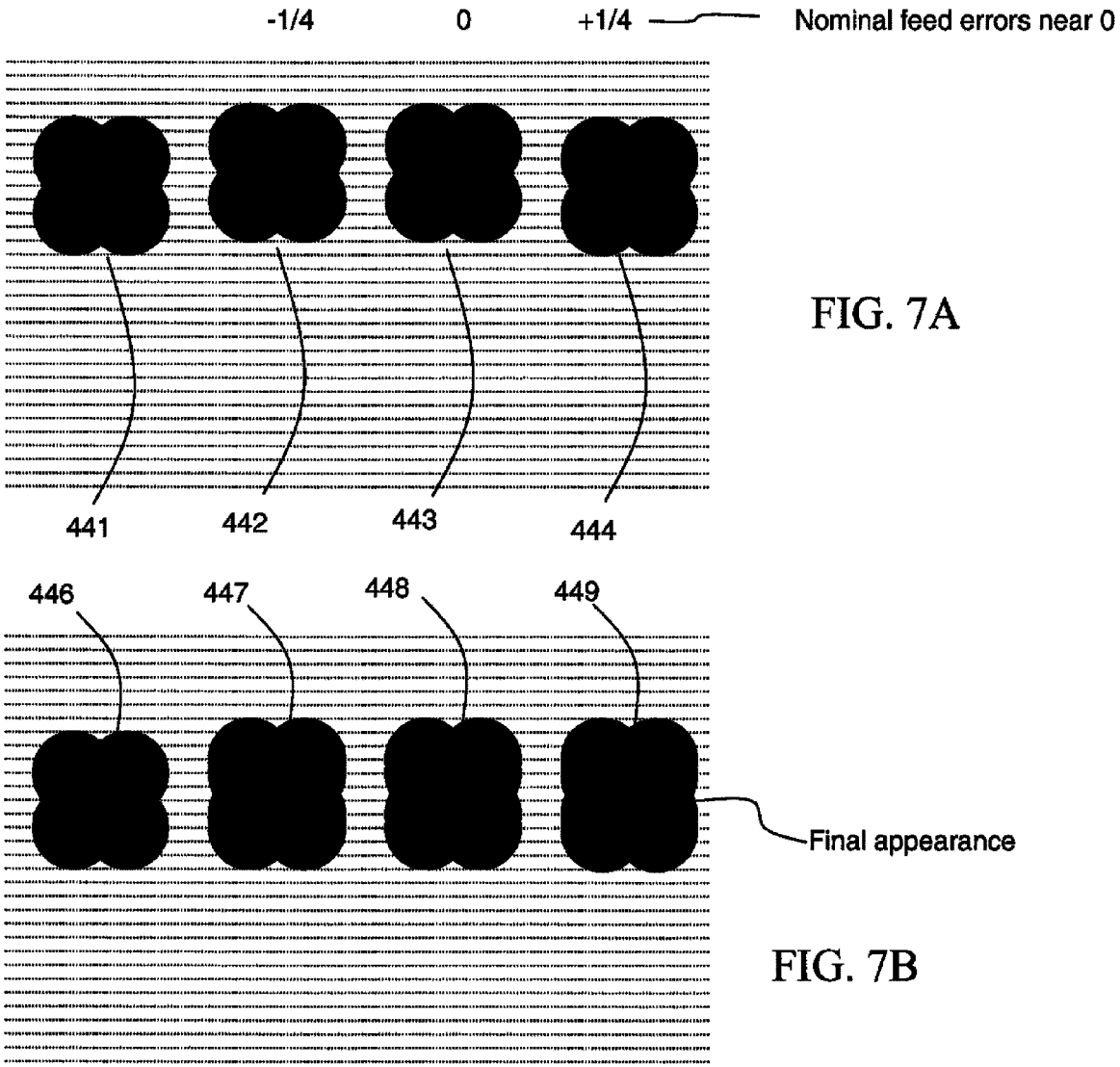
FIGS. 7-10 show magnified views of dot clusters of a media feed calibration target, with the amount of overlap varying in different regions of the target.
Figures 8A, 8B:
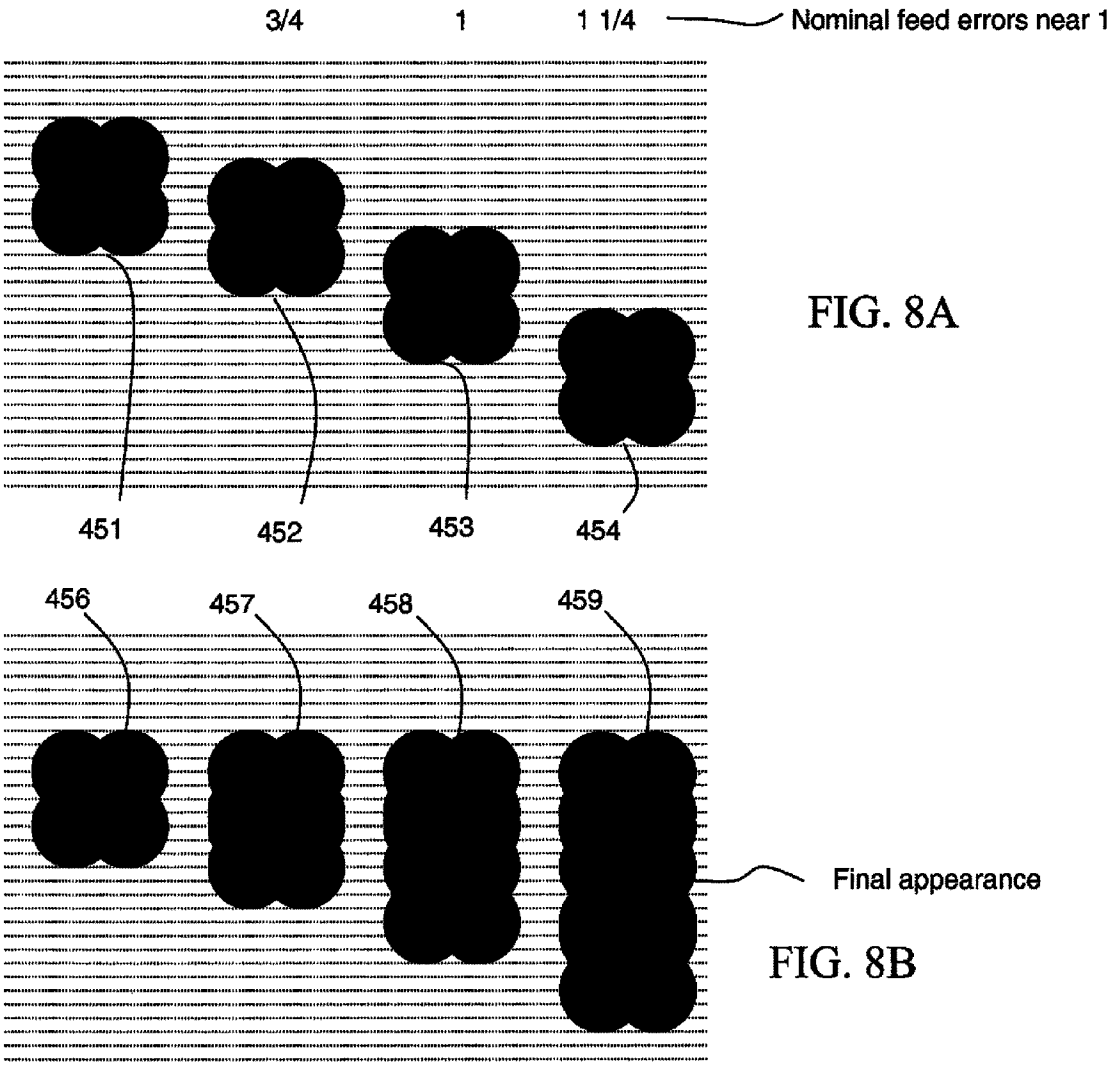

FIGS. 8A and 8B are similar to FIGS. 7A and 7B, but for media feed errors near +1 pixel spacing. Dot cluster 451 is printed by nozzles 1 and 2 and is the same as dot cluster composite 456 after one pass. Dot cluster 452 is offset vertically from dot cluster 451 by 0.75 pixel spacing, so that dot cluster composite 457 covers significantly more paper than dot cluster composite 456. Dot cluster 453 is offset vertically from dot cluster 452 by one pixel spacing and from dot cluster 451 by 1.75 pixel spacings, so that dot cluster composite 458 is even larger. Finally dot cluster 454 is offset vertically from dot cluster 452 by 1.25 pixel spacings, and from dot cluster 451 by 3.0 pixel spacings. The final appearance of dot cluster composite 459 after 4 passes is what the dot cluster composites would nominally look like in boxes d and f in FIG. 6.

Figure 9:
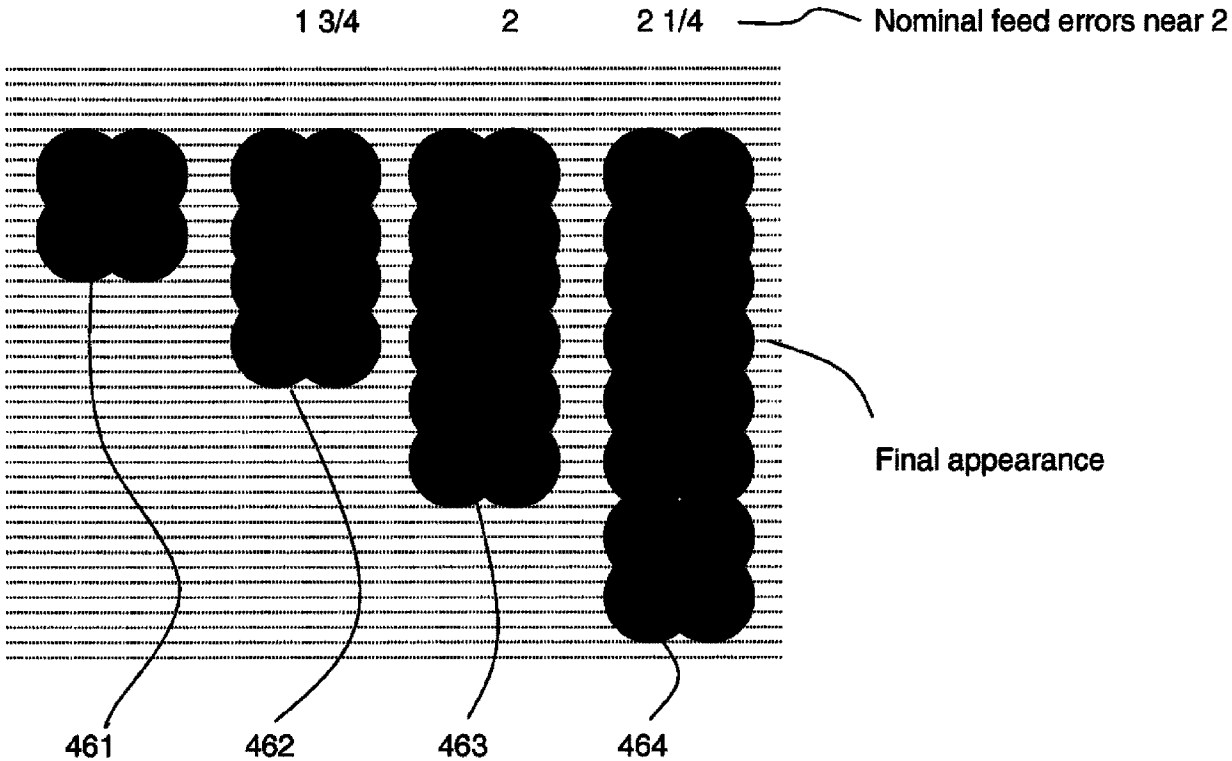
Figure 10:
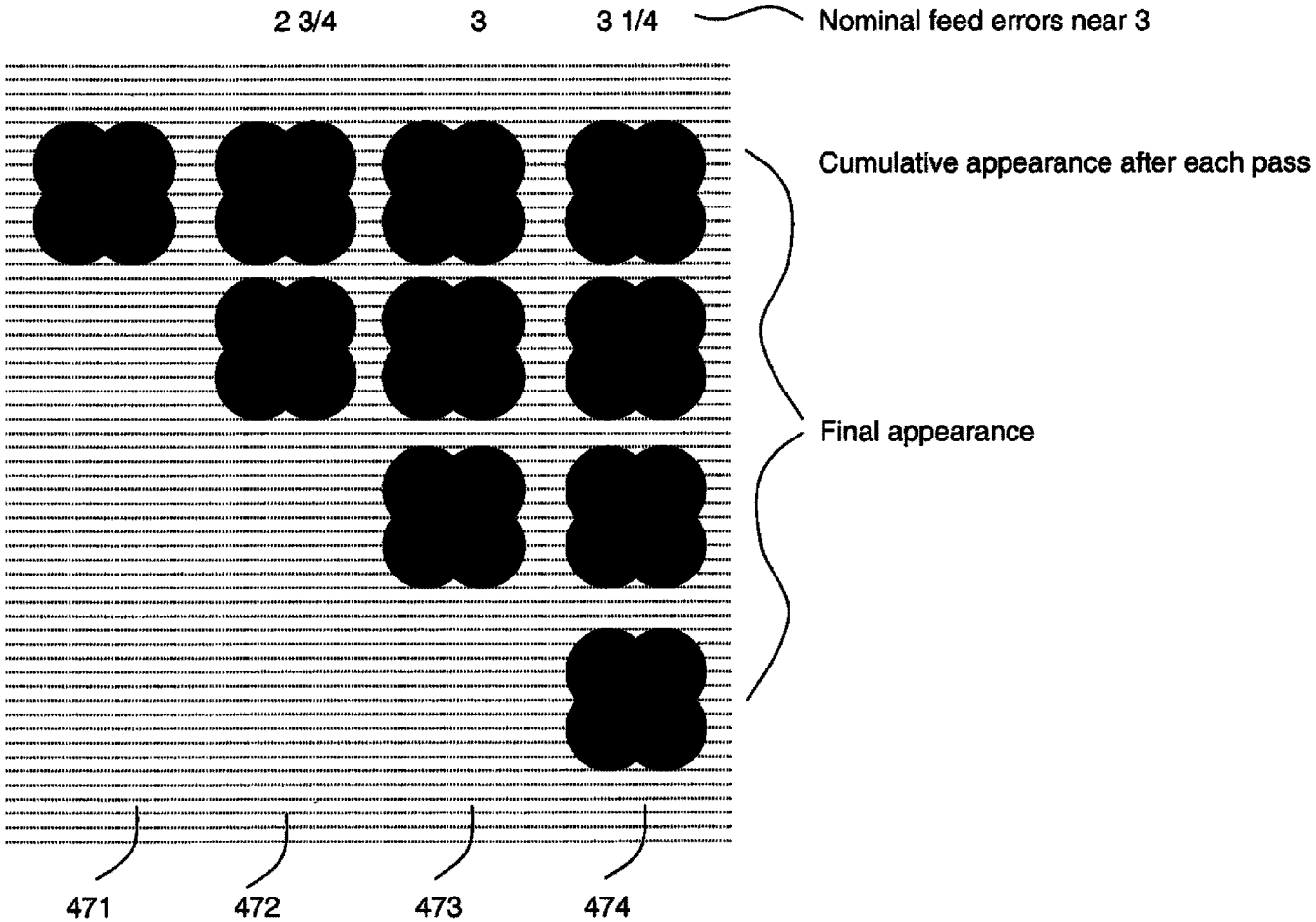

In FIGS. 9 and 10, only the composite dot clusters are shown after each of the four passes. Dot cluster composite 462 consists of a dot cluster like 461 plus another dot cluster that is vertically offset from 461 by 1.75 pixel spacings. Dot cluster composite 463 consists of dot cluster composite 462 plus another dot cluster that is vertically offset from 461 by 1.75+2.0=3.75 pixel spacings. Dot cluster composite 464 consists of dot cluster composite 463 plus another dot cluster that is vertically offset from 461 by 6.0 pixel spacings. The final appearance of dot cluster composite 464 is what the dot cluster composites would nominally look like in boxes c and g in FIG. 6.

In FIG. 10, dot cluster composite 472 consists of a dot cluster like 471 plus another dot cluster that is vertically offset from 471 by 2.75 pixel spacings. Note that the two dot clusters making up dot cluster composite 472 are completely separate from each other. They will cover no additional paper by spreading even further apart. (By contrast, a 2×3 dot cluster geometry would still provide overlap in the dot cluster composite at this amount of vertical offset between clusters.) Dot cluster composite 473 consists of dot cluster composite 472 plus another dot cluster that is vertically offset from 471 by 2.75+3.0=5.75 pixel spacings. Dot cluster composite 474 consists of dot cluster composite 473 plus another dot cluster that is vertically offset from 471 by 9.0 pixel spacings. The final appearance of dot cluster composite 474 is what the dot cluster composites would nominally look like in boxes b and h in FIG. 6.

As described above relative to FIG. 6, after the media feed calibration target 430 is printed, the carriage 200 is moved into position so that carriage sensor 210 is aligned with target 430. Photosensor data is stored as a function of nominal position provided by the rotary encoder. FIG. 11A shows a plot 530 of photosensor data versus position corresponding to target 430. Target 430 has been rotated clockwise 90 degrees in FIG. 11B relative to FIG. 6 and lined up approximately with plot 530 for a clearer understanding of how various parts of the plot relate to various parts of the target 530.

Regions 431 outside of the media feed calibration target 430 consist of white paper, corresponding to the highest values 531 of the photosensor signal (approximately a value of 620 on the vertical axis in the plot 530 shown in the example of FIG. 11A). If the target 430 is scanned from the end 439 toward the end 437, then as more and more of the target 430 enters the field of view 212 of the photosensor, the photosensor signal decreases. At location 539 of plot 530, the edge 439 is in the center of the field of view 212 of the photosensor, and the signal level has dropped to about midway between its maximum level and its minimum level. Similarly at location 537 of plot 530, the edge 437 is in the center of the field of view of the photosensor, and the signal level rises again to about midway between its maximum level and its minimum level.

The region of the media feed calibration target near left edge 439 is the region where overfeeding has occurred (i.e. feeding greater than 160 pixel spacings), which results in white streaks 432. As a white streak 432 enters the field of view 212, the photosensor signal increases correspondingly until the white streak exits the field of view. The white streaks 432 entering and exiting the field of view 212 of the photosensor is what gives rise to the jagged bumps 532 in the data curve 530.

Point 433 of the media feed calibration target 430 is midway between end 439 and end 437. This midway point corresponds to point 533 on data plot 530. Point 533 is found by finding the midway position (given by the position on the horizontal axis) between points 539 and 537.

The peak 535 in photosensor signal for the reflectance data occurs when the field of view 212 is centered on the lightest region 435 of the target 430. This is the portion where there is maximum overlap of the dot clusters. If the target 430 is designed to be symmetrical, and if the media feed is nominally accurate, then the peak 535 will occur approximately at midway point 533, rather than being displaced from midway point 533 as it is in FIG. 11A.

The plot 530 is smoother in appearance between the peak 535 and end 537 than it is between the peak 535 and end 539. This is because the reflectance change at the swath boundaries for this target is not as apparent for underfeeding as it is for the white streaks 432 on the dark gray background.

The separation distance between the peak point 535 and the midway point 533 can be used to calculate the media feed error. The horizontal scale in FIG. 11A is in units of $1/600$ inch. In the example of FIG. 11A, the peak 535 occurs at a position of 2156 and the midway point 533 occurs at a position 2000. Thus the distance between the peak 535 and the midway point 533 is $156/600$ inch, which is the same as $312/1200$ inch. Since the media feed was incremented by 0.25 pixel for every swath of about $160/1200$ inch, and since the peak 535 is on the underfed side of the midway point 533, the desired media feed as measured relative to peak 535 is given by:

$$\text{desired media feed} = 160/1200'' - (312/160)\,(0.25/1200'')$$

$$\sim 160/1200'' - 0.4875/1200''.$$

In actuality, a small error is made when the expression 312/160 is used. A slightly better calculation would be to use the average number of pixel spacings of media advance on the underfed side of the target 430 between the midway point 430 and the peak position 435 rather than the nominal distance of 160 pixel spacings in the ratio 312/160. In this case that is the average of 160 and 159.75, i.e. 159.875 pixel spacings. However, the error is less than one part in 1000 (i.e. the result of the better calculated value is $160/1200''-0.4879/1200''$, which is almost the same as the result provided above for the desired media feed).

In the printing system in which this method was tested, the resolution of the rotary encoder corresponded to one twelfth of a pixel spacing, i.e. to 0.083/1200", so errors that are less than half that value (i.e. 0.041/1200") are negligible in this example. Even if the peak value 535 were as far to the right as an underfeed of about 3 pixel spacings, corresponding to coordinate 3000 on the horizontal axis of the plot in FIG. 11A (which is about as far out as the peak could be and still be recognized as a peak) the use of the nominal value 160 pixel spacings in the calculation still provides a negligible error to the nearest 1/12 pixel spacing, which is the resolution of the rotary encoder in our example. Even though the media feed has not previously been calibrated, the nominal value of 160 pixel spacings can be used in the calculation, without making a substantial error in the determination of the desired correction for the rotary encoder.

Thus, in the above example, in order to provide the correct media feed, the intended value at the rotary encoder should not correspond to 160 pixel spacings, but 159.49 pixel spacings, which is rounded off to 159.5 to the nearest 1/12 pixel spacing. This is a correction of half a pixel spacing or 6 counts on the rotary encoder since the rotary encoder resolution is one twelfth of a pixel spacing in this example. Thus, the proper rotary encoder rotation can be adjusted by minus 6 encoder counts to provide the half pixel correction value in order to provide the proper amount of media feed. In other words, rather than the rotary encoder count for media feed being 160×12=1920, the corrected rotary encoder count for a proper media feed in this example would be 1914.

In the example described above, the maximum amount of overlap of the dot clusters in the media feed calibration target 430 was identified as the peak 535 in the reflectance value. An alternative is to use the centroid 546 of the peak region rather than the peak 535 itself. Using the centroid can have an advantage of averaging to reduce the impact of dot misplacement due to mechanical vibration, for example. In the example shown in FIG. 11A, centroid 546 was calculated as follows. First, select the region near the peak 535. This can be done by first truncating the data on the left at position 543 and at the right at position 544. Truncation positions 543 and 544 are selected to be a known distance (such as 200 units on the horizontal axis) inside the positions of the ends 537 and 539. Then a threshold value 542 is identified. This threshold value 542 can be selected on the basis of the maximum and minimum values between truncation positions 543 and 544. In this example, threshold value 542 was selected as:

Threshold value=minimum+0.25(maximum−minimum)~200.

The region for centroid calculation is then chosen as the values between truncation positions 543 and 544 that exceed the threshold 542. The threshold value (200) is then subtracted from the data in this region of curve 530 to produce peak region curve 540. The centroid position 546 is the position such that the area under the curve 540 to the left of centroid 546 is equal to the area under the curve 540 to the right of centroid 546.

In the example of FIG. 11A, the centroid 546 is located at horizontal position 2166 compared to the horizontal position 2156 of peak 535 that was used in the calculation above. Thus the distance between the centroid 546 and the midway point 533 is 166/600 inch, which is the same as 332/1200 inch. Since the media feed was incremented by 0.25 pixel for every swath of about 160/1200 inch, and since the centroid is on the underfed side of the midway point 533, the desired media feed as measured relative to centroid is given by:

Desired media feed=160/1200"−(332/160)(0.25/1200")

~160/1200"−0.5188/1200".

To the nearest one twelfth of a pixel spacing (the resolution of the rotary encoder), the correction as calculated by the reflectance centroid method is thus minus one half a pixel spacing (i.e. minus 6 encoder counts), just as it was for the calculation by the reflectance peak method in this example.

Referring back to exemplary mask 400 in FIG. 5 that controls the printing of the dots in the media feed calibration target, note that the mask entries in zone 401 are identical to the mask entries in zones 402, 403 and 404. Such a mask configuration is advantageous, in that for the region of greatest overlap of the dots printed by the multipass printing, the greatest amount of white paper will be exposed, so that the peak in optical reflectance is pronounced at the correct media feed. However, the method will still work even if the mask entries are not identical from zone to zone, but are predominantly the same from zone to zone. In the example of mask 400, each zone of the mask has 100 entries, consisting of twenty 1's and eighty 0's. For all 100 entries, if there is a 0 in a particular location for zone 401, there will be a 0 in the corresponding location for zone 402, etc. and similarly for locations of 1's. While it is not required that the mask entries in one zone be exactly the same as the entries in a second zone, the method works better if more than 75% of the mask entries are the same in the second zone as they are in the first zone.

As described above, each zone of mask 400 includes twenty 1's and eighty 0's. In other words, the number of pixels designated by each zone of the mask as to be marked is 20% of the total number of pixels in the zone. A mask that is relatively sparsely populated by 1's is advantageous such that as the media feed is progressively incrementally overfed or underfed, marked regions do not start overlapping other marked regions. However, depending upon factors such as how far the underfeeding or overfeeding is incremented, the method will still work for greater than 20% of the pixels in a zone being marked. The 2×3 cluster described above would correspond to 30% of the pixels in a zone being marked. The method works better if the number of pixels designated by each zone of the mask as marked is less than 50% of the pixels in the zone.

Again referring to the example FIGS. 5-10, the 2×2 marking clusters printed in one pass have a dimension S along the media feed direction such that S is 2 spacings. (The printed dot diameter is generally a bit larger than 1.414 times the vertical or horizontal pixel spacing so that the dots will overlap along the diagonal, but the corresponding dimension S in the mask is 2 pixel spacings.) Adjacent the 2×2 clusters of 1's in mask 400 along the media feed direction 305 (or marking element array direction 254) is an isolation region of 2×8 0's. In other words, the isolation region has a dimension along the media feed direction that is 8 spacings, i.e. 4 times S. Although it is not required that the isolation region be as large as 4 times S, the method works better if the dimension of the isolation region along the media feed direction is greater than S. In addition, in mask 400, the isolation region is made up only of 0's. Although it is not required that there be no 1's in the isolation region, the method works better if fewer than 25% of the pixels in the isolation region are designated for marking. Also, it is not required that the marked pixels be in dot clusters, nor that each cluster have all of the adjacent pixels in the media advance direction being designated for marking, but the dot clusters in FIGS. 5-10 have that property.

The amount of media feed increment (i.e. the offset amount between successive passes) in the examples described above was 0.25 pixel spacing, i.e. 0.25 d, where d is the distance between neighboring marking elements. The choice of 0.25 d as the offset amount (i.e. the amount of increase or decrease of the media advance distance in successive passes) works well, but other choices are possible. The method works better if the offset amount is less than 2 d.

Note also that the nominal media advance corresponding to the rotary encoder resolution in the examples described above is 1/12 d, i.e. 0.083 d, which is less than the 0.25 d amount of increase or decrease of the media advance distance in successive passes. It has been demonstrated that the inventive method of calibrating a media advance in a printer is capable of identifying a correction value that is smaller than the amount of increase or decrease of the media advance distance in successive passes. In some embodiments, it is advantageous to use an offset amount (e.g. 0.25 d) in the media advance sweep that is greater than the nominal media advance distance (e.g. 0.083 d) corresponding to the rotary encoder resolution. This is because fewer swaths are required to print the pattern, making the pattern more compact. In addition such a media feed calibration target can be less susceptible to noise from pass to pass, due for example to dot misplacement resulting from mechanical vibration in the printing system.

Although the need for precision and convenience have driven the development of the embodiments described above in which calibration of media feed is done automatically, the method could also be adapted for manual calibration embodiments.

In the embodiments described above, the intent of the calibration is to quantify and correct for the component of media feed error that is independent of angular position of the feed roller. In some printing system applications, the feed roller is sufficiently round and the mechanical mounting is sufficiently precise that no further correction is needed. However, in some printing systems, feed rollers may be not precisely circular in cross-section, or they may be eccentrically mounted, or there may be wobble or noise or other deviation from a constant media feed amount for a constant angular rotation of the feed roller.

The methods described above can be used to quantify and correct for periodic variation or noise in the media feed. In addition to the angular scale of the rotary encoder, a marker (which can be part of the rotary encoder, for example) is provided to indicate a particular angular position of the roller. The first step then is to calibrate the media feed so that the angular-position-independent component of the error is quantified, for example, by measuring optical reflectance due to the overlap of dot clusters for a range of media feed amounts as described in embodiments above. Then use the same mask (e.g. exemplary mask 400), but in this case set the media feed amount between swaths to a corrected amount based on the measurement of the angular-position-independent component of the error (i.e. not sweeping the media feed incrementally, but keeping it constant at a corrected value). After printing the target, align the carriage 200 with the target so that it can be scanned with the carriage sensor 210 as the media is advanced past it. Measure the optical reflectance versus position, where position is correlated relative to the marker that indicates a particular angular position of the roller. A printing system with significant run-out or eccentricity of the roller will show a periodic variation (e.g. sinusoidal) in reflectance. The optical reflectance data as a function of position then can be used to characterize the proper number of encoder counts to rotate the roller as a function of roller position. Suppose the nominal media feed distance corresponds to $^{160}/_{1200}$" or 1920 encoder counts, but the corrected media feed distance corresponds to 1914 encoder counts (as in the above example). In measuring the angular dependence it might be found that at 0 degrees relative to the roller marker, the proper media feed distance corresponds to 1916 encoder counts, while at 90 degrees it is 1914, at 180 degrees it is 1912, and at 270 degrees it is 1914 (with the overall average being 1914 for a full rotation of the roller). These angular variations can be stored in a table in printer controller 14 and used to correct for the media feed advance as a function of roller angular position.

Such calibration can be done at the factory or by the user. If there is excessive noise or variation found at the factory (detected as excessive variation in the reflectance of the target), that assembly can be reworked or rejected before leaving the factory.

The invention has been described in detail with particular reference to certain preferred embodiments thereof, but it will be understood that variations and modifications can be effected within the scope of the invention.

PARTS LIST

10 Inkjet printer system
12 Image data source
14 Controller
15 Image processing unit
16 Electrical pulse source
18 First fluid source
19 Second fluid source
20 Recording medium
100 Ink jet printhead
110 Ink jet printhead die
111 Substrate
120 First nozzle array
121 Nozzle in first nozzle array
122 Ink delivery pathway for first nozzle array
130 Second nozzle array
131 Nozzle in second nozzle array
132 Ink delivery pathway for second nozzle array
181 Droplet ejected from first nozzle array
182 Droplet ejected from second nozzle array
200 Carriage
210 Carriage sensor
212 Field of view of carriage sensor
250 Printhead chassis
251 Printhead die
253 Nozzle array
254 Nozzle array direction
256 Encapsulant
257 Flex circuit
258 Connector board
262 Multichamber ink supply
264 Single chamber ink supply
300 Printer chassis
302 Paper load entry
303 Print region
304 Paper exit
305 Carriage scan direction
306 Right side of printer chassis
307 Left side of printer chassis
308 Front portion of printer chassis
309 Rear portion of printer chassis
310 Hole for paper advance motor drive gear
311 Feed roller gear
312 Feedroller
313 Forward rotation of feed roller
319 Feed roller shaft
320 Pickup roller
322 Turn roller
323 Idler roller
324 Discharge roller
325 Star wheel
330 Maintenance station
370 Stack of media
371 Top sheet
372 Main paper tray
373 Photo paper stack

374 Photo paper tray
376 Recess in paper tray
380 Carriage motor
382 Carriage rail
383 Encoder fence
384 Belt
390 Printer electronics board
392 Cable connectors
400 Mask for media feed calibration target
401 First zone of mask
402 Second zone of mask
403 Third zone of mask
404 Fourth zone of mask
406 Cluster
407 Isolation region
420 Marking element array
430 Media feed calibration target
431 Region outside target
432 White streaks due to overfeeding
433 Point midway between ends of target
434 Central position of target
435 Lightest region of target
436 End region of target
437 End of target
438 End region of target
439 End of target
440*a-i* Magnified view boxes
441-444 Dot clusters
446-449 Dot cluster composites
451-454 Dot clusters
456-459 Dot cluster composites
Dot cluster composites
Dot cluster composites
530 Plot of photosensor data
531 Photosensor data for region 431
531 Bump in data corresponding to white streak 432
533 Photosensor data corresponding to target center 433
535 Peak of reflectance data
537 Photosensor data for end 437 in center of field of view
539 Photosensor data for end 439 in center of field of view
540 Peak region curve
542 Threshold value
543, 544 Truncation positions
546 Centroid of peak region

The invention claimed is:

1. A method of calibrating a media advance in a printer, the printer including an array of marking elements that are disposed along a direction that is substantially parallel to a direction of media advance, the method comprising:

providing a mask to specify a printing configuration of a calibration target;

forming a media feed calibration target on a print media by:

i. printing the calibration target on the print media using the array of the marking elements, ii. advancing the print media by a media advance amount, iii. printing the calibration target on the print media using the array of the marking elements;

iv. advancing the print media by the previous media advance amount plus an offset amount, and v. repeating steps iii. and iv. until the media feed calibration target is complete;

measuring the optical reflectance of the media feed calibration target as a function of position along the media advance direction;

identifying a position of the media feed calibration target to the location at which a maximum in the optical reflectance occurs; and comparing the location at which a maximum in the optical reflectance occurs to a predetermined location of the media feed calibration target along the media advance direction to calibrate media advance in the printer.

2. The method of claim 1, wherein identifying the position along the media feed calibration target corresponding to the location at which the maximum in the optical reflectance occurs includes identifying the position of a peak in the optical reflectance.

3. The method of claim 1, wherein identifying the position along the media feed calibration target corresponding to the location at which the maximum in the optical reflectance occurs includes analyzing a centroid of the optical reflectance.

4. The method of claim 1, wherein printing the calibration target on the print media using the array of the marking elements includes printing the calibration target using a multiple pass mode including m passes, the mask being configured to specify locations of marked and unmarked pixels for each pass such that a pixel location of the calibration target is printed by a first marking element on a first pass, and the same pixel location of the calibration target is printed by a second marking element on a second pass.

5. The method of claim 4, the mask being configured to have m zones, wherein more than 75% of the mask entries in a first zone are the same as the mask entries in the corresponding positions in a second zone.

6. The method of claim 5, wherein the number of pixels designated by each zone of the mask as marked is less than 50% of the total number of pixels in the zone.

7. The method of claim 5, each zone of the mask comprising:

a marking cluster including a plurality of pixels designated to be marked, the marking cluster having a dimension S along the direction of media advance; and an isolation region adjacent to the marking cluster along the direction of media advance, the isolation region having a dimension along the media advance direction that is greater than S, wherein less than 25% of the pixels of the isolation region are designated for marking.

8. The method of claim 7, wherein the marking cluster comprises a plurality of adjacent pixels along the direction of media advance, wherein each of the plurality of adjacent pixels is designated for marking.

9. The method of claim 7, wherein the marking cluster comprises a two dimensional group of pixels that are designated to be marked.

10. The method of claim 4, the array of marking elements that are used to print the calibration target having a length L, wherein the media advance amounts are increased or decreased in successive passes such that the minimum media advance distance is less than L/m and the maximum media advance distance is greater than L/m.

11. The method of claim 10, a distance between neighboring marking elements being d, wherein the amount of increase or decrease of the media advance distance in successive passes is less than 2d.

12. The method of claim 10, wherein the predetermined location of the media feed calibration target to calibrate media advance in the printer corresponds to a media advance distance equal to L/m.

13. The method of claim 1, the mask being configured to have a plurality of zones, each zone of the mask comprising:

a marking cluster including a plurality of pixels designated to be marked, wherein a degree of overlap between marking clusters printed by different marking elements according the different zones of the mask varies as a function of the media advance distance such that the optical reflectance increases as the degree of overlap increases.

14. The method of claim 1, the media feed calibration target having a center, wherein the predetermined location of the media feed calibration target is the center of the target.

15. The method of claim 1, wherein measuring the optical reflectance of the media feed calibration target as a function of position along the media feed calibration target includes scanning the media feed calibration target using an optical sensor.

16. The method of claim 1, the printer further comprising:

a media feed roller; and a rotary encoder that is mounted coaxially with the media feed roller, the rotary encoder including a resolution, wherein the offset amount is greater than a nominal media advance amount corresponding to the resolution of the rotary encoder.

17. The method of claim 1, the printer including a media advance roller, the method further comprising:

adjusting rotation of the media advance roller based on the calibrated media advance.

18. The method of claim 1, the printer including a media advance roller and a marker to indicate a particular angular position of the roller, the method further comprising:

forming a second media feed calibration target on the print media by:

i. printing the calibration target on a print media using the array of the marking elements, ii. advancing the print media by a media advance amount, iii. printing the calibration target on the print media using the array of the marking elements;

iv. advancing the print media by the previous media advance amount, and v. repeating steps iii. and iv. until the media feed calibration target is complete;

measuring the optical reflectance of the second media feed calibration target as a function of position along the second media feed calibration target;

identifying and storing a periodic variation in the optical reflectance as a function of angular rotation; and adjusting rotation of the media advance roller based on the stored periodic variation and the position of the marker that indicates the particular angular position of the roller.

* * * * *

UNITED STATES PATENT AND TRADEMARK OFFICE

CERTIFICATE OF CORRECTION

PATENT NO. : 7,762,642 B2
APPLICATION NO. : 12/241112
DATED : July 27, 2010
INVENTOR(S) : Peter J. Fellingham et al.

It is certified that error appears in the above-identified patent and that said Letters Patent is hereby corrected as shown below:

| Issued Patent | | Description of Error |
|---|---|---|
| **Column** | **Line** | |
| 18 | 1 | In Claim 1, delete "target" and insert --target along the media advanced direction corresponding--, therefor. |

Signed and Sealed this
Fifth Day of April, 2011

David J. Kappos

David J. Kappos
*Director of the United States Patent and Trademark Office*